US006049993A

United States Patent [19]

Baris

[11] Patent Number: 6,049,993

[45] Date of Patent: Apr. 18, 2000

[54] SYSTEM FOR ADAPTING A DRY CLEANER MACHINE TO THE USE OF HYDROCARBON-BASED CLEANING FLUIDS

[75] Inventor: Ertan Baris, Rochester, N.Y.

[73] Assignee: Global Solutions, Inc., Rochester, N.Y.

[21] Appl. No.: 09/168,652

[22] Filed: Oct. 8, 1998

Related U.S. Application Data

[60] Provisional application No. 60/061,887, Oct. 14, 1997.

[51] Int. Cl.[7] ..... F26B 19/00

[52] U.S. Cl. ..... 34/85

[58] Field of Search ..... 34/218, 76, 72, 34/79, 83, 84, 85

[56] References Cited

U.S. PATENT DOCUMENTS

| | | | |
|---|---|---|---|
| 2,639,599 | 5/1953 | Wellford . | |
| 4,150,494 | 4/1979 | Rothchild . | |
| 4,475,293 | 10/1984 | Banerjee | 34/27 |
| 5,241,976 | 9/1993 | Ikawa . | |
| 5,423,921 | 6/1995 | Saal et al. . | |

*Primary Examiner*—Henry Bennett
*Assistant Examiner*—Malik N. Drake
*Attorney, Agent, or Firm*—Harris Beach & Wilcox, LLP.

[57] ABSTRACT

A system for adapting a dry cleaner machine to the use of hydrocarbon-based cleaning fluids provides a purging gas flow of an inert gas through the machine and through articles to be cleaned in a cleaning compartment therein prior to introduction of the hydrocarbon-based cleaning fluid. The system further provides a maintenance gas flow of an inert gas through the machine during at least a cleaning cycle and a drying cycle. The maintenance gas flow also flows through an aspirating device which communicates with an interior portion of the machine and which aspirates gas samples therefrom. The oxygen level of the gas samples is sensed and monitored, with the maintenance gas flow adjusted to maintain the oxygen level safely below a limit value. At least a portion of the purging gas flow and the maintenance gas flow is exhausted from the machine at two locations, the locations selected to provide a uniform bathing of all interior components of the machine in the inert gas flow.

5 Claims, 5 Drawing Sheets

10
dry cleaner machine
13
10a
100
51
50
52
141
FROM 100
56
54
53
122
128
120
124
126
127
129
(P)
158
156
155
159
ON/OFF
157
154
152
112
114
116(ASP)
oxygen level monitor
130
131
electrical power cut-off
140
141
TO 10
pressurized inert gas supply tank
8
6
inert gas generator
4
1
2

10
10a
170
126
141
121
130
131
140
129
128
127
122
123
124
120
116 (ASP)
157
ON
OFF
114
154
156
159
158 (P)
162
1
8
4
6
2

SYSTEM FOR ADAPTING A DRY CLEANER MACHINE TO THE USE OF HYDROCARBON-BASED CLEANING FLUIDS

This application claims the priority benefit of Provisional Application Ser. No. 60/061,887, filed Oct. 14, 1997.

FIELD OF THE INVENTION

The present invention relates generally to dry cleaner machines and more particularly to a system for adapting a dry cleaner machine designed for use with fluorocarbon or chlorofluorocarbon cleaning fluids to the use of hydrocarbon-based cleaning fluids.

BACKGROUND OF THE INVENTION

Due to increasing environmental concerns about, and due to increasing environmental regulations regarding the use of chlorofluorocarbon (CFC) cleaning fluids or of perchloroethane (PERC) cleaning fluids traditionally used in dry cleaner machines, the use of such nonflammable cleaning fluids in dry cleaners is likely to be prohibited in the near future. Volatile cleaning fluids, for example, hydrocarbon (HC) cleaning fluids such as alcohols, ketones, or petroleum fractions are cleaning fluids having excellent cleaning properties, but they may be flammable or ignitable, particularly when vapors of such volatile fluids interact with oxygen gas or with air at elevated temperature under certain conditions in a dry cleaner machine. Accordingly, a very large number of existing dry cleaner machines designed for use with nonflammable cleaning fluids cannot safely remain operative by simply exchanging the aforementioned nonflammable cleaning fluids with volatile cleaning fluids that generally have a flash point at a temperature comparable to or lower than a temperature frequently developed within a dry cleaner machine during certain operating cycles, for example, during a drying cycle.

While it is anticipated that manufacturers of dry cleaner machines will develop and manufacture a new generation of dry cleaner machines specifically designed for use with HC-based volatile cleaning fluids. The substantial financial cost of such new-generation machines presents a significant economic burden to operators of many small dry cleaning establishments. Thus, there is a strong economic incentive to devise a system and a method of operation which would adapt currently existing dry cleaner machines to the safe use of HC-based cleaning fluids, particularly if such adaptation or conversion could be accomplished by a system using readily commercially available parts or components.

The present invention is directed to providing such a system for adapting a dry cleaner machine designed for use with nonflammable cleaning fluids to the use of HC-based cleaning fluids, as will be described in more detail hereinafter. The inventive aspect of the adaptive system and the process of using same, resides in a particularly effective arrangement of commercially available components and in a particular sequence of process steps. Such a system for adapting an existing dry cleaner machine for use of HC-based cleaning fluids in accordance with the present invention has been built by the inventor and has been fully operative for several months by following a sequence of inventive process steps in operating the adapted dry cleaner machine.

Various proposals have been made to address certain aspects related to the use of flammable or ignitable cleaning fluids or cleaning solvents to safely clean or safely dry articles to be cleaned or to be dried. For example, Wellford, U.S. Pat. No. 2,639,599 proposes a closed-system dry cleaning apparatus utilizing volatile solvent in which it is proposed to introduce an inert gas into a receiving chamber of the apparatus after the work contained therein has been cleaned and the cleaning fluids have been withdrawn, so that the inert gas intermingles with remaining traces of a volatile solvent and thereby to inhibit an explosion. U.S. Pat. No. 5,241,976 to Ikawa discloses cleaning equipment for cleaning articles to be cleaned with flammable solvent in which it is proposed to supply any one of steam, steam and nitrogen, and steam and carbon dioxide to an inlet pass box and to an outlet pass box of a cleaning chamber, so as to cut off the communication of gas between a cleaning atmosphere in the cleaning chamber and the outside air. U.S. Pat. No. 5,423,921 to Saal et al discloses a method and apparatus for cleaning textiles by means of benzene-based solvents, and having a separate cleaning machine and a separate dryer, and having means for injecting protective gas into the dryer. U.S. Pat. No. 4,475,293 to Banerjee discloses a method of controlled inerting of chamber 10 atmospheres in a curing oven or a dryer in which it is proposed to withdraw solvent vapor formed in the chamber together with inert gas at a substantially constant flow rate. And U.S. Pat. No. 4,150,494 to Rothchild discloses methods and apparatus for recovering solvents in which an inert gas is supplied to the vicinity of an oven entrance and exit to substantially exclude oxygen from the oven during the curing of solvent born coatings.

As will become apparent hereinafter, none of the above cited disclosures suggest a combination of elements or a sequence of process steps which characterize a dry cleaner machine adapted to the use of hydrocarbon (HC)-based cleaning fluids in accordance with the present invention.

SUMMARY OF THE INVENTION

It is an object of the present invention to provide a system for adapting a dry cleaner machine designed for use with fluorocarbon and/or chlorofluorocarbon cleaning fluids to the use of hydrocarbon-based cleaning fluids.

It is another object of the present invention to adapt a dry cleaner machine to the use of HC-based cleaning fluids by adapting means which are readily commercially available.

It is a further object of the present invention to provide a system for dapting a dry cleaner machine to the use of HIC-based cleaning fluids in which the system provides for initial purging of the machine with an inert purging gas flow and for maintaining an inert gas flow through the machine during at least a cleaning cycle and a drying cycle.

It is a still further object of the present invention to provide a system for adapting a dry cleaner machine to the use of HC-based cleaning fluids in which means for maintaining an inert gas flow through the machine includes means for continuously aspirating gas samples from the machine, means for sensing an oxygen level in the gas samples, and means for adjusting the maintained inert gas flow such that the oxygen level in the gas samples is maintained below a limit value.

These and other objects of the invention are achieved in a system for adapting a dry cleaner machine to the use of HC-based cleaning fluids in which the system includes:

means for purging a dry cleaner machine and articles to be cleaned in a cleaning compartment therein with a controlled purging gas flow of an inert gas prior to introduction of HC-based cleaning fluids into said compartment;

means for maintaining an inert gas flow through an aspirating device which is in communication with said machine and continuously aspirates gas samples therefrom, said inert gas flow maintained at least during a cleaning cycle and during a drying cycle of said machine;

means of sensing an oxygen level in said gas samples;

means for monitoring said oxygen level;

means for controlling said maintained inert gas flow through said aspirating device such that said oxygen level in said gas samples is maintained below a limit value;

means for circulating said controlled maintained inert gas flow and said gas samples through said dry cleaner machine; and means for exhausting a portion of said purging gas flow and a portion of that maintained gas flow from two locations within the dry cleaner machine.

DESCRIPTION OF PREFERRED EMBODIMENTS

It should be noted that the term "dry cleaner machine" as used herein denotes a commercial apparatus designed for use with nonvolatile cleaning fluids or cleaning solvents which is sealed and which contains all of the fluid management components, all of the air or gas handling components, drive means for rotating or for tumbling a cage in which articles to be cleaned are disposed, all control means and functions required to operate the machine through a sequence of cleaning and drying cycles, as well as solvent filtration, distillation, and recovery components. In the ensuing description, only those components, parts, or functions of the dry cleaning machine which pertain to the inventive system of adapting the machine to use with HC-based cleaning fluids will be further elaborated.

Figure 1:
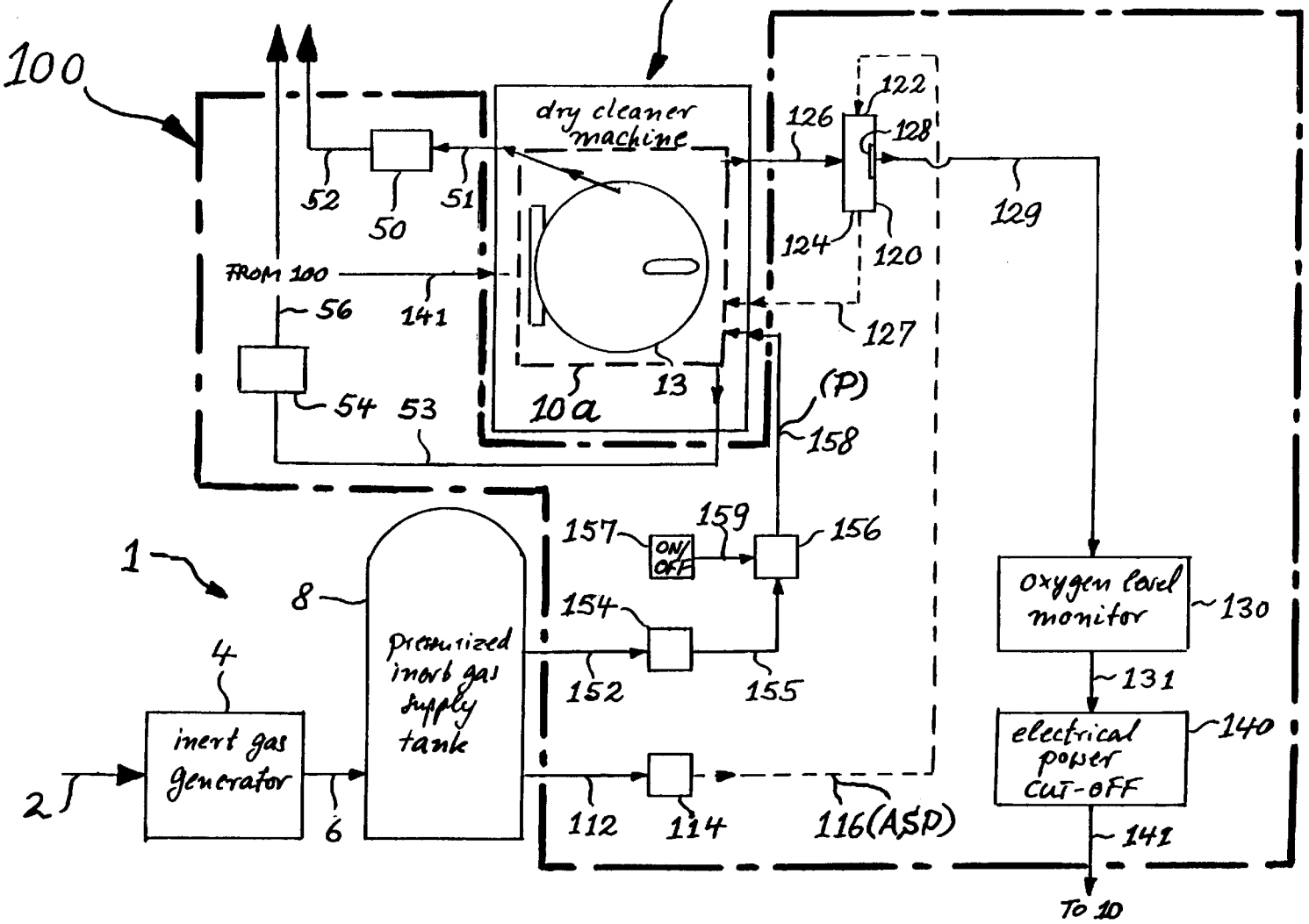
FIG. 1 is a schematic block diagram depicting a dry cleaner machine to be adapted for use with hydrocarbon cleaning fluids by the system in accordance with the present invention, shown within bold outline.

Referring now to FIG. 1, there is shown a schematic block diagram of a dry cleaner machine designated at 10, an inert gas generator and inert gas supply tank generally designated at 1, and the system for adapting the dry cleaner machine to the use of HC-based cleaning fluids in accordance with the invention, generally designated at 100. The inventive adaptive system 100 generally includes inert gas transporting and controlling means for providing inert gas flow purging and inert gas flow maintenance to the dry cleaner machine 10, and to exhaust means for exhausting a portion of the purging gas flow and a portion of the maintenance gas flow from two different locations within the dry cleaner machine 10, as will be detailed hereinafter.

Referring briefly to the inert gas generator and the supply tank, the inert gas generator 4 is preferably a nitrogen gas generator which separates nitrogen gas from a compressed air input 2 and provides at an output thereof through a conduit 6 a pressurized inert nitrogen gas to a tank 8. The nitrogen gas generator 4 is, for example, a Model 75-79-K551 available from Whatman, Inc. of Haverhill, Mass., and the inert tank 8 is, for example a Model 102-613 available from Silvan Industries, Inc. of Marinette, Wis. The compressed air input 2 has a pressure range between about 100–125 psi and the gas generator 4 charges the tank 8 with nitrogen gas at a pressure in the range of 50–100 psi, the tank having a capacity of about 80 pounds. and a pressure rating of about 200 psi.

Alternatively, the inert gas generator 4 and the storage tank 8 can be replaced by a cylinder of pressurized inert gas such as, for example, a cylinder of nitrogen gas or a cylinder of argon gas.

Turning now to the inventive system 100 for adapting the dry cleaner machine 10 to the use of HC-based cleaning fluids, a series of gas conduits 152, 155, and 158 provide a purging gas flow from the tank 8 to a selected location within the dry cleaner machine 10 (see FIGS. 2 and 4 for details) for controlled purging of the machine 10 with inert gas via a regulator valve 154 and a solenoid type shut off valve 156 which is actuated by a timer 157 connected to the solenoid valve 156 by a lead 159. It has been determined that a duration of the purging gas flow (P) in the range from 2–6 minutes at a purging flow pressure in the range from about 6–12 psi is sufficient to completely purge the dry cleaner machine 10 and any articles contained therein for cleaning once the access door 13 of the dry cleaning machine has been closed. The effectiveness of inert gas purging of the machine 10 is measured by an oxygen sensor 128 and is displayed by an oxygen level monitor 130 of the system, to be described in more detail hereinafter.

A gas conduit 112 connects the tank 8 to a regulator valve 114 which regulates an aspirating (ASP) gas flow through a gas conduit 116 to an inlet port 122 of an aspirating device 120. The aspirating gas flow, shown in dashed outline, passes through the aspirating device 120 to an exit port 124 and enters the dry cleaner machine 10 via a gas conduit 127 to be directed within the machine to a particular location therein (see FIGS. 2 and 4 for details) for circulation through the machine 10. The aspirating device 120 continuously aspirates gas samples from a location within the machine 10 which are drawn from the machine to the aspirator device 120 via a conduit 126. Depicted schematically within the aspirating device 120 is an oxygen sensor 128 for sensing the oxygen level of the aspirated gas samples and which provides an electrical signal corresponding to a sensed oxygen level via an electrical lead or via electrical leads 129 to an input of an oxygen level monitor 130. The monitor 130 provides a calibrated and visual display of the oxygen level contained in the aspirated gas samples, and the monitor 130 contains means for selecting an upper limit value of an oxygen level as well as signal processing circuits which will actuate an electrical power cutoff module 140 via an electrical connection 131 when the selected oxygen level limit value is reached or exceeded. The electrical power cutoff module 140 is connected via a connection 141 to the dry cleaner machine 10, and is operative to cut off electrical power to all components of the machine 10 upon receiving an appropriate signal from the oxygen level monitor 130.

The aspirating device 120 is preferably of a venturi-type design and can be obtained commercially as part number 35-5161 from Gastech, Inc. of Newark, Calif. A preferred oxygen sensor 128 is an oxygen sensor Model GT-OX also available from Gastech, Inc. and the oxygen level monitor 130 can be a Model SAFE-T-NET 100 available from Gastech, Inc.

In the practice of the present invention it has been found that the regulator valve 114 can be adjusted to deliver an aspirating gas flow in a pressure range of 2–5 psi, and the aspirating gas flow can be continuous even when the access door 13 of the dry cleaner machine 10 is opened for either removing articles or for loading articles to be cleaned, providing that the upper level limit of the oxygen level monitor is raised sufficiently during periods when the access door 13 is opened such that the monitor 130 will not trigger the electrical power cutoff monitor 140 during those periods. In any event, when the access door is opened at the end of a cleaning and drying cycle of the machine 10, volatile and potentially ignitable solvent vapors will have been sufficiently diluted by the continuously maintained aspirating gas flow which, as indicated above, passes through the aspirating device 120 together with the continuously aspirated gas samples for recirculation through the machine 10. Thus, the aspirating gas flow (ASP) serves two purposes critical to the present invention, namely, to provide continuous aspiration of gas samples from the machine 10 for determination of the oxygen level within these gas samples, and to provide together with the aspirated gas samples, a maintenance flow of substantially inert gas through the machine 10, thereby diluting vapors of cleaning fluids and reducing the oxygen level of the gas samples to a level of about 2–3 percent, which is significantly below a level of oxygen at which vapors of HC-based cleaning fluids are flammable or ignitable even at an elevated drying cycle temperature of about 160° F.

Turning now to the exhaust portion of the inventive system 100, FIG. 1 schematically indicates an exhausting gas flow conduit 51 emanating from an upper portion of the machine 10 and connected to an inlet port of a check valve 50 whose outlet port is connected to an exhaust conduit 52 for exhausting a portion of both the purging gas flow during the purging step as well as exhausting a portion of the inert gas maintenance flow (the aspirating gas flow ASP). Another exhausting gas flow conduit 53 is schematically shown to emanate from a lower right hand portion of the machine 10. Conduit 53 is connected to a check valve 54 which transmits gases through an exhaust conduit 56 to be exhausted. Both check valves 50 of the first exhaust and check valve 54 of the second exhaust have a pressure setting in the direction of the exhaust gas flow of about 2–2.5 psi, thus ensuring that the inside of the dry cleaner machine 10 remains at a positive inert gas pressure of about 2–2.5 psi both during the gas purging step and during the continuous maintenance gas flow (ASP).

Figure 2:
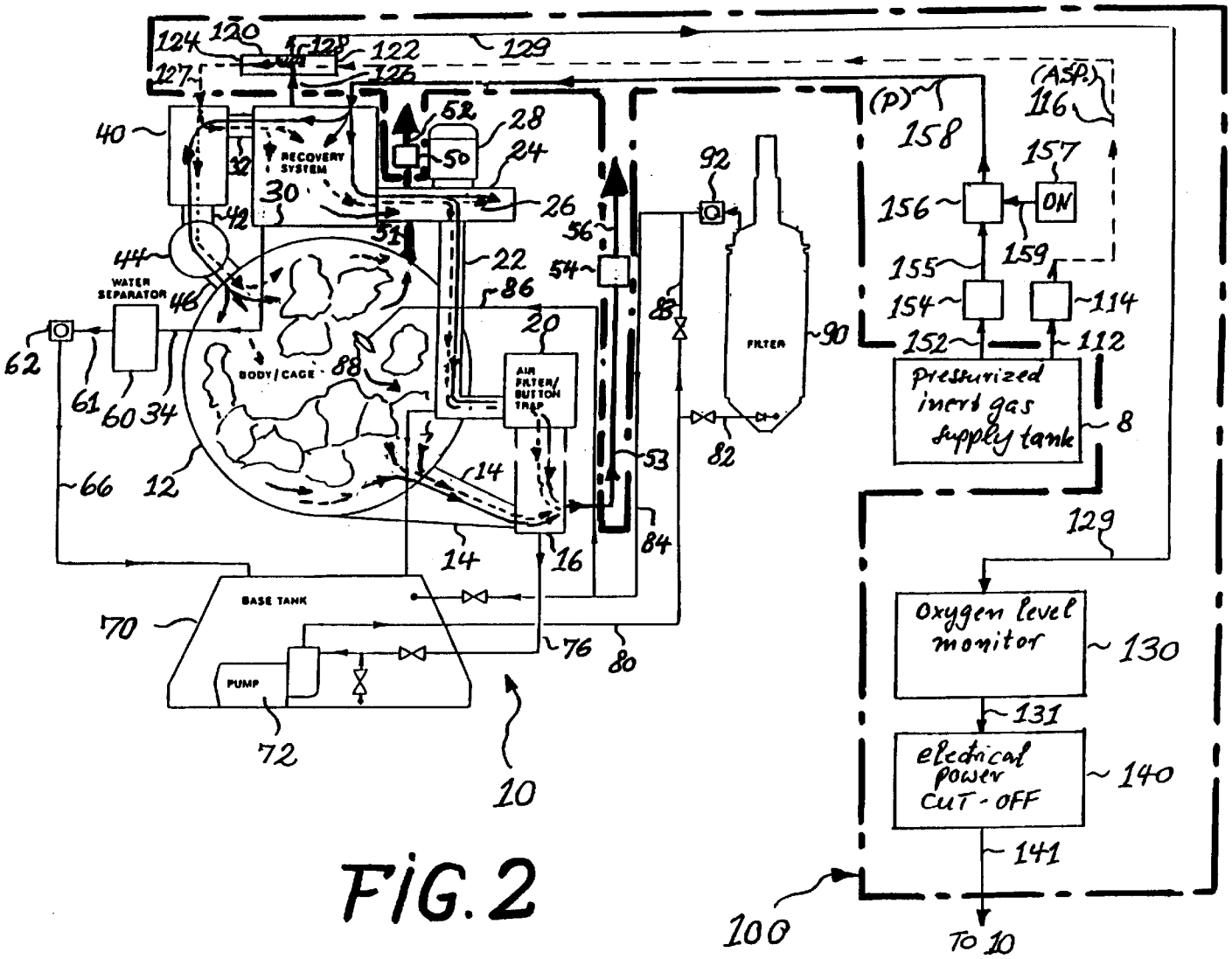
FIG. 2 is a schematic view of the inventive system similar to that shown in FIG. 1, together with a more detailed schematic view of a dry cleaner machine containing articles to be cleaned and through which the flow paths of both an inert purging gas flow and an inert maintaining gas flow are indicated.

Turning now to FIG. 2, there is shown a schematic view of the inventive system similar to that shown in FIG. 1, but providing a more detailed view of the dry cleaner machine 10 containing articles to be cleaned, and depicting in more detail the currently preferred entry ports of the purging gas flow and of the aspirating gas flow described previously, as well as the currently preferred locations of the respective exhaust conduits extending from the dry cleaner machine 10 to the two exhausts.

Addressing first the gas flow aspects, the machine 10 is depicted to be in a cycle where both the purging gas flow (P) through conduit 158, shown in solid outline, and the maintenance gas flow or aspirating gas flow (ASP) through conduit 116 (shown in dashed outline) are entering the machine 10 and are circulating therethrough including through the cage 12 containing articles to be cleaned (shown in schematic outline). The inert gas flows shown as entering near upper portions of the machine 10 are well dispersed through all portions of the machine, thereby bathing all internal components of the sealed dry cleaner machine 10, including the articles to be cleaned. This uniform bathing of machine components and articles is brought about by appropriate selection of the locations at which the inert gases enter the machine relative to the particular locations within the machine 10 from which a portion of the gas flows are exhausted through the respective exhaust conduits 51 and 53. Thus, shown schematically, the exhaust conduit 51 is exhausting a portion of the inert gases from a location within a sealed body surrounding the perforated cage 12, while an exhaust conduit 53 exhausts a portion of the flowing gases from a location near the lower right hand portion of the machine 10. To achieve uniform distribution throughout the interior of the machine 10 of both the purging gas flow and the maintenance gas flow, the present invention therefore specifically contemplates the selection of locations at which inert gases enter the machine and the locations from which a portion of the gases is exhausted from within the machine 10.

Upon the termination of the timed purging gas flow (P), the aspirating gas flow (ASP) will continue through the machine as the machine enters a cleaning cycle and a subsequent drying cycle.

Describing now briefly the fluid handling of the dry cleaner machine, now adapted for use with HC-based cleaning fluids, a base tank 70 contains the cleaning fluid which is pumped by a pump 72 through conduits 80, 88, 84, and 86 to extend into a cleaning fluid dispensing device 88 positioned within the machine cage 12. If a filtration is called for by a sensor and program of the machine, the pump 72 pumps the cleaning fluid through conduits 80, 82, through a standard filter pack 90 and past a float 92 to the conduit 84 and into the dispensing device 88. During the cleaning cycle, the cage containing the articles to be cleaned may undergo an oscillating or rocking motion imparted to the cage by a drive motor (not shown). Upon completion of the cleaning cycle, a freely flowing quantity of cleaning fluid is discharged from the cage through a discharge port 14 into a button trap 16 to return to the tank 70 via a conduit 76. Remaining moisture and cleaning fluid vapors are then substantially removed from the cleaned articles and from interior portions of the machine 10 by actuating a fan motor 28 to rotate a fan 26 so as to draw moisture and vapors from the cage through the exit port 14 into the button trap 16 and from there upwardly through an air filter 20 and a conduit 22 to a vapor recovery system 30 in which cooling coils provide condensation of hydrocarbon vapors and water vapor. The recovered cleaning fluid and water are directed through a conduit 34 into a water separator 60 which substantially separates the cleaning fluid from the water. The cleaning fluid separated from the water in the separator 60 is returned to the base tank 70 via a conduit 61, a float 62, and a conduit 66. The water separated in the water separator 60 is collected from a lower portion of the separator and is stored in a container for subsequent controlled disposal since the water may contain a residual quantity of hydrocarbon cleaning fluid.

During the drying cycle a heat pump 40 and heating elements 44 heat the inert maintenance gas (entering the machine via conduit 127) which is now unidirectional by virtue of the rotating fan 26. Actual experience in using an adapted system has shown that the oxygen level sensed by the sensor 128 and displayed by the oxygen level monitor 130 remains consistently below about 3 percent during the cleaning and drying cycles due to the maintenance flow of inert gas through the machine 10.

Upon completion of the drying cycle the cleaned and dried articles are removed from the cage 12 through the cage access door 13 (see FIG. 1) and a new load of articles to be cleaned is placed in the cage.

Figure 4:
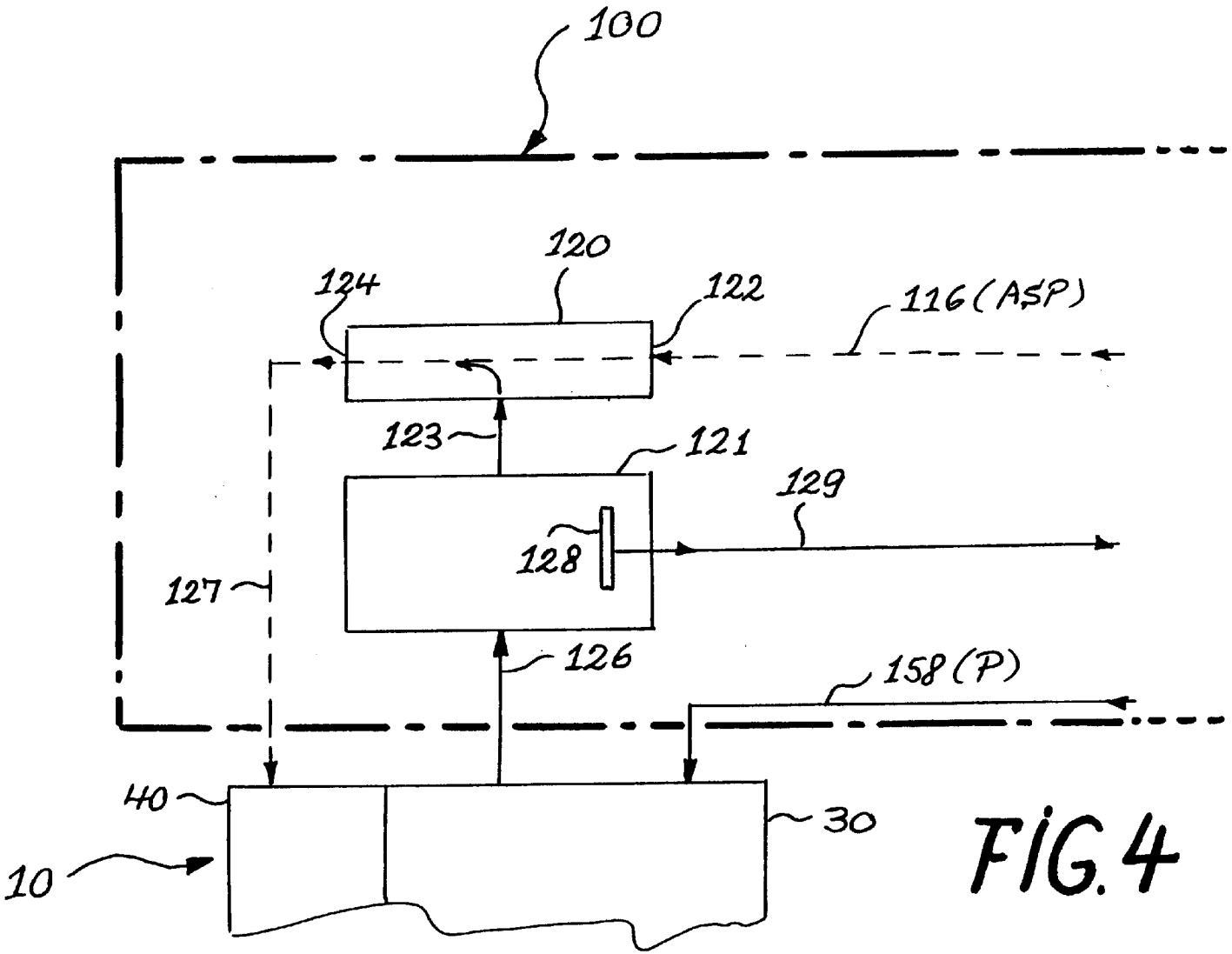
FIG. 4 is a schematic view of a preferred arrangement of some elements of the inventive system of FIGS. 1 and 2.

Turning now to FIG. 4 there is shown an enlarged view of the gas flow components of the inventive system at a location adjacent to a top portion of the dry cleaner machine 10. In this preferred embodiment the aspirator conduit 126 enters a measuring chamber 121 which contains the oxygen sensor 128, with the chamber 121 in turn being aspirated by the aspirating device 120 via a conduit 123. In this enlarged view of the aspirating device 120 the continuously aspirated gas samples (not otherwise identified) are shown by a curved arrow to mix within the aspirating device 120 with the aspirating gas flow (ASP) therethrough for return and recirculation through the machine 10 via the gas flow conduit 127.

Figure 3:
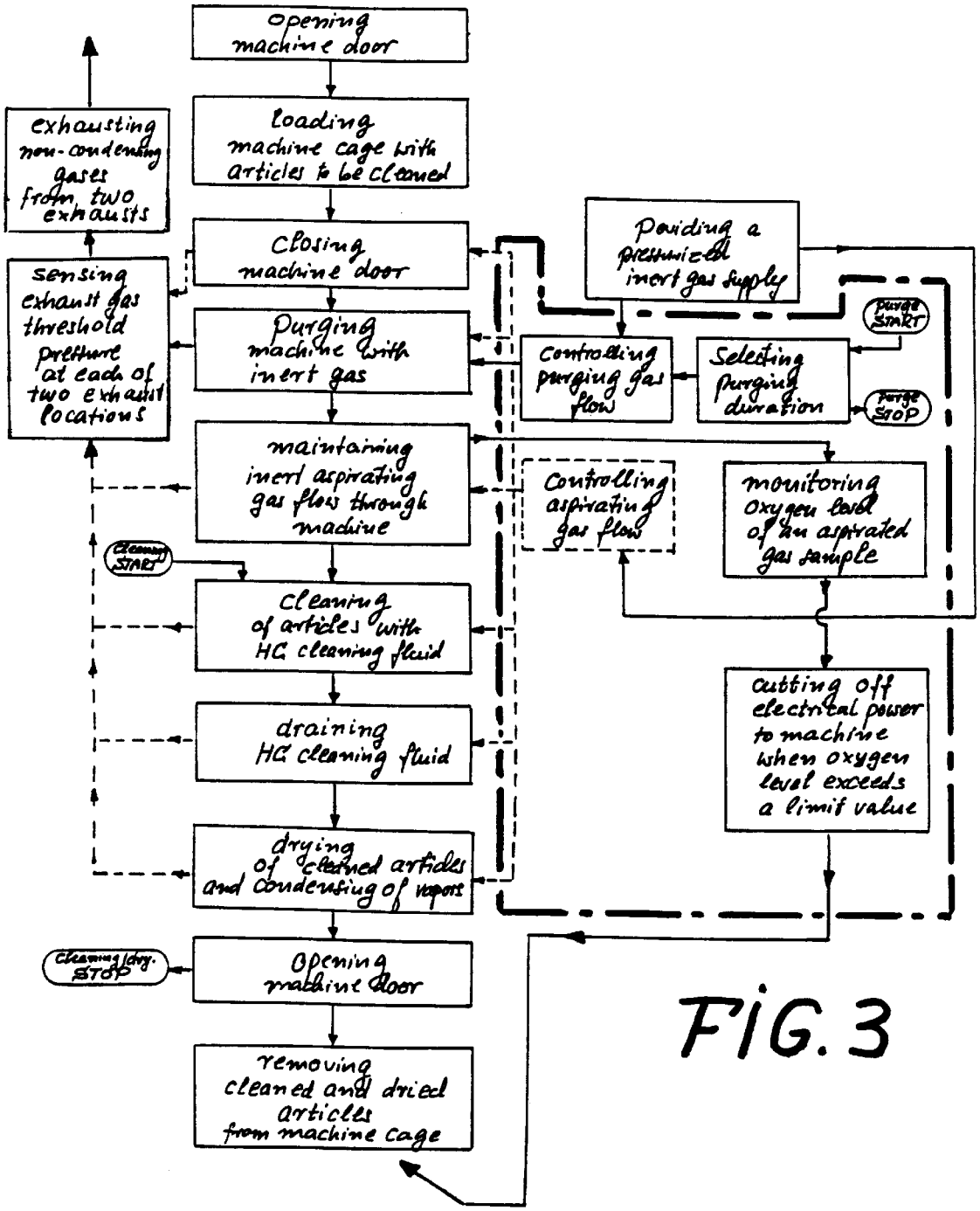
FIG. 3 is a schematic flow diagram of a sequence of process steps characteristic of a dry cleaning process, in which the inventive steps (shown within a bold outline) are adapting the dry cleaning process to the use of HC-based cleaning fluids.

Referring now to FIG. 3. there is depicted a schematic flow diagram of a sequence of process steps characteristic of a dry cleaning process in which the inventive steps (shown within a bold outline) are adapting the dry cleaning process to the use of hydrocarbon cleaning fluids. In particular, the aspirating gas flow is controlled by the regulator valve 114 shown in FIGS. 1 and 2 to achieve an aspirating gas flow through the dry cleaner machine 10 which ensures that the monitoring of the oxygen level indicates an oxygen level safely below a level at which cleaning fluid vapors would be flammable or ignitable.

It should also be noted that the sensing of the exhaust gas threshold pressure at each of two exhaust locations is performed by selecting check valves 50 and 54 to have appropriate pressure settings in the direction of flow of the exhaust gases.

Figure 5:
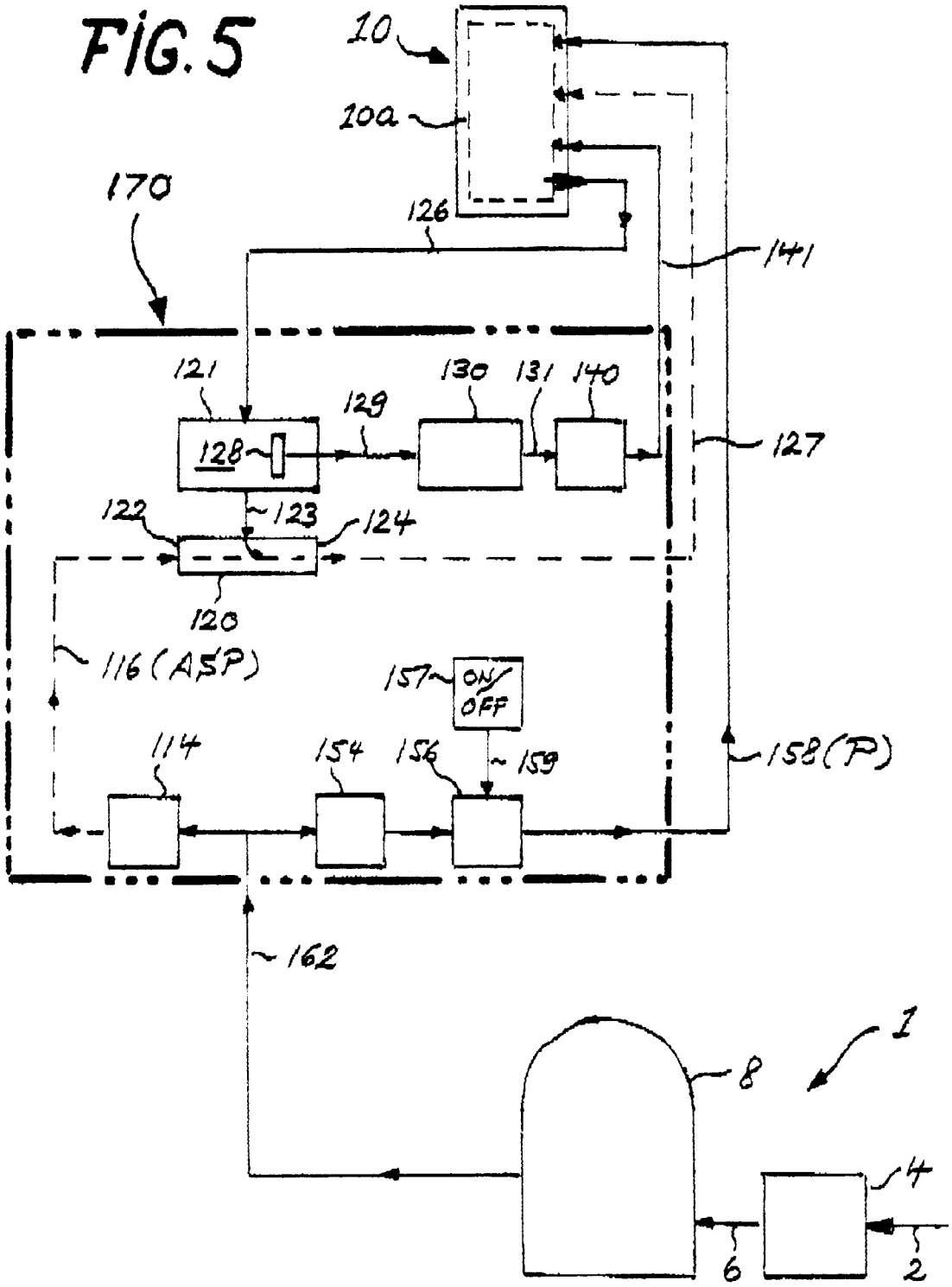
FIG. 5 is a schematic diagram of a preferred embodiment of a system provided by the invention.

Referring to FIG. 5, a particularly preferred embodiment of the inventive system includes a control panel 170 which has disposed therein all of the control elements, measuring elements and switching elements described previously with reference to FIGS. 1, 2, and 4. The control panel 170 is advantageously mounted on a front surface or on a side surface of the dry cleaner machine 10. Thus, in a preferred configuration the adaptive system comprises a dry cleaner machine 10 to be adapted to the use of HC-based cleaning fluids, an inert gas supply sub-system designated at 1, the control panel 170, and a plurality of conduits (126, 127, 141, 158, and 162) which connect the control panel 170 to the dry cleaner machine 10 and to the inert gas supply sub-system 1 so as to provide the previously described functions of purging gas flow, maintenance gas flow, and monitoring of oxygen levels of gas samples.

Although the present invention has been described with respect to certain preferred embodiments, various changes and modifications may be suggested to one skilled in the art. For example, the particular locations at which the purging gas flow and the maintenance gas flow are introduced into the dry cleaner machine, and the particular locations at which gases are exhausted from the dry cleaner machine can be selected providing that such selection of locations results in a uniform bathing of all interior portions and components of the dry cleaner machine in the inert gas flow therethrough. It is therefore intended that the present invention encompass such changes and modifications as fall within the scope of the appended claims.

What is claimed is:

1. A system for adapting a dry cleaner machine to the use of hydrocarbon (HC)-based cleaning fluids, the improvement comprising:

means for purging a dry cleaner machine and articles to be cleaned in a cleaning compartment therein with a controlled purging gas flow of an inert gas prior to introduction of HC-based cleaning fluids into said compartment;

means for maintaining an inert gas flow through an aspirating device which is in communication with said machine and continuously aspirates gas samples therefrom, said inert gas flow maintained at least during a cleaning cycle and during a drying cycle of said machine;

means of sensing an oxygen level in said gas samples;

means for monitoring said oxygen level;

means for controlling said maintained inert gas flow through said aspirating device such that said oxygen level in said gas samples is maintained below a limit value;

means for circulating said controlled maintained inert gas flow and said gas samples through said dry cleaner machine; and means for exhausting a portion of said purging gas flow and a portion of that maintained gas flow from two locations within the dry cleaner machine.

2. A process of adapting a dry cleaner machine to the use of hydrocarbon (HC)-based cleaning fluids, wherein the improvement comprises the steps of:

purging a dry cleaner machine and articles to be cleaned in a cleaning compartment therein with a controlled purging gas flow of an inert gas prior to introduction of HC-based cleaning fluids into said compartment;

maintaining an inert gas flow through an aspirating device which is in communication with said machine and continuously aspirates gas samples therefrom, said inert gas flow maintained at least during a cleaning cycle and during a drying cycle of said machine;

sensing an oxygen level in said gas samples;

monitoring said oxygen level;

controlling said maintained inert gas flow through said aspirating device such that said oxygen level in said gas samples is maintained below a limit value.

circulating said controlled maintained inert gas flow and said gas samples through said dry cleaner machine; and exhausting a portion of said purging gas flow and a portion of that maintained gas flow from two locations within the dry cleaner machine.

3. The system of claim 1 wherein said purging gas flow and said maintained gas flow comprise controlled flows of nitrogen gas.

4. The system of claim 1 wherein said means for purging includes a solenoid valve, a timing device of actuating said solenoid valve, a pressure regulator valve, and conduits which conduct a purging gas flow between a supply of inert gas and the dry cleaner machine to be purged.

5. The system of claim 1 wherein said means for purging, said means for maintaining an inert gas flow, said means for sensing an oxygen level, said means for monitoring said oxygen level, and said means for controlling said maintained inert gas flow are disposed in a control panel for controlling the flow of inert gas and gas samples and for sensing and monitoring said oxygen level in said gas samples.

* * * * *